United States Patent [19]

Odermann

[11] Patent Number: 4,457,245

[45] Date of Patent: Jul. 3, 1984

[54] BOBBIN WINDING ACTUATION BY PRESSER FOOT UP SWITCH

[75] Inventor: Charles R. Odermann, Montville, N.J.

[73] Assignee: The Singer Company, Stamford, Conn.

[21] Appl. No.: 525,909

[22] Filed: Aug. 24, 1983

[51] Int. Cl.[3] ..... D05B 69/02; D05B 69/20

[52] U.S. Cl. ..... 112/221; 112/237; 112/279; 112/262.1

[58] Field of Search ..... 112/221, 237, 184, 238, 112/239, 279, 121.11, 158 E, 262.1

[56] References Cited

U.S. PATENT DOCUMENTS 3,750,603 8/1973 Martin ..... 112/121.11

3,815,532 6/1974 Weisz et al. ..... 112/221

4,216,733 8/1980 Kornatowski ..... 112/221 X

*Primary Examiner*—Peter P. Nerbun

*Attorney, Agent, or Firm*—Edward P. Schmidt; Robert E. Smith; Edward L. Bell

[57] ABSTRACT

An apparatus and method for implementing bobbin winding in place in a looptaker of a sewing machine. When a presser foot lift lever is manipulated to elevate a presser foot, and the sewing machine motor is activated, a series of two or three endwise reciprocations of the sewing machine is effected to bring an upper thread to the lower thread carrying bobbin, after which further endwise reciprocation of the sewing needle is held in abeyance while actuation of the sewing machine motor is continued, to provide the least disturbance of upper thread passage to the lower thread bobbin. No other bobbin winding signaling steps are required.

3 Claims, 4 Drawing Figures

BOBBIN WINDING ACTUATION BY PRESSER FOOT UP SWITCH

DESCRIPTION

Background of the Invention

This invention is in the field of sewing machines; more particularly, it is concerned with a simplified arrangement for implementing bobbin winding in place in a looptaker of a sewing machine.

In a prior art family lock stitch sewing machine having the capability to wind a lower thread bobbin in place in the sewing machine looptaker, several steps were required after the need for lower thread was perceived, including, firstly, raise the presser foot to release the tension from the tension discs so as to allow thread to run freely from the upper large thread supply through the needle eye to the lower thread bobbin. Secondly, it is necessary to open the bed slide plate to expose the bobbin winding mechanism and actuate the bobbin winding latch to the winding position. Thirdly, a blindstitch pattern was selected in which several stitches are skipped and three stitches are made in a continuous sequence. In this way, a three stitch sequence could be provided in which an upper thread was brought down to the sewing machine looptaker in order to load an upper thread on the bobbin, as is taught in the U.S. Pat. No. 3,693,566, of Ketterer which was issued on Sept. 26, 1972. Fourthly, a single pattern repeat symbol must also be selected which will provide that only a single blind stitch sequence would be implemented, so that a repeated up and down motion of the needle which might impede a smooth flow of thread from the spool to the bobbin might be avoided. Fifthly, a thread ending from the sewing needle eye must be drawn underneath the elevated presser foot and wrapped around the thumb retaining screw for the presser foot, in order to provide a sufficient tautness to the trailing thread end for a loop to be thrown that might be picked up by the loop taker.

It would be advantageous to simplify the above process insofar as possible. Many of the above steps, however, are not readily eliminated since the thread tension must be released, the bobbin winding mechanism must be armed and, steps must be taken to insure that a thread loop is provided for the loop taker.

What is required is an apparatus and/or method which will simplify bobbin winding. Advantageously, this method should be implemented as economically as possible.

SUMMARY OF THE INVENTION

The above requirements are attained in a sewing machine having a switch actuated by elevation of the sewing machine presser bar, a means for counting endwise reciprocations of the sewing machine needle bar, and a circuit responsive to a selected number of endwise reciprocations of the needle bar to actuate a basting mechanism to halt such continued endwise reciprocation. Such a device is readily implemented in an electronically controlled sewing machine, by using an arm shaft position sensor as a stitch completion indicator, which indications are counted up in a counter that is reset by a presser foot up switch to initiate a stitch count. When a selected number of stitches has been implemented with the presser foot elevated, a basting mechanism on the needle bar may be actuated by a solenoid activated by way of the counter, or by a bight linear motor of the sewing machine in a basting arrangement where basting is implemented by overthrow of the needle bar gate beyond the range of stitch positions. Thus, the selection of a blind stitch pattern and a single pattern repeat is no longer necessary, equivalent steps having been implemented by raising the presser foot.

DETAILED DESCRIPTION OF THE INVENTION

With the above and additional objects and advantages in view, as will hereinafter appear, this invention will now be described with reference to the accompanying drawing of a preferred embodiment in which.

Figure 1:
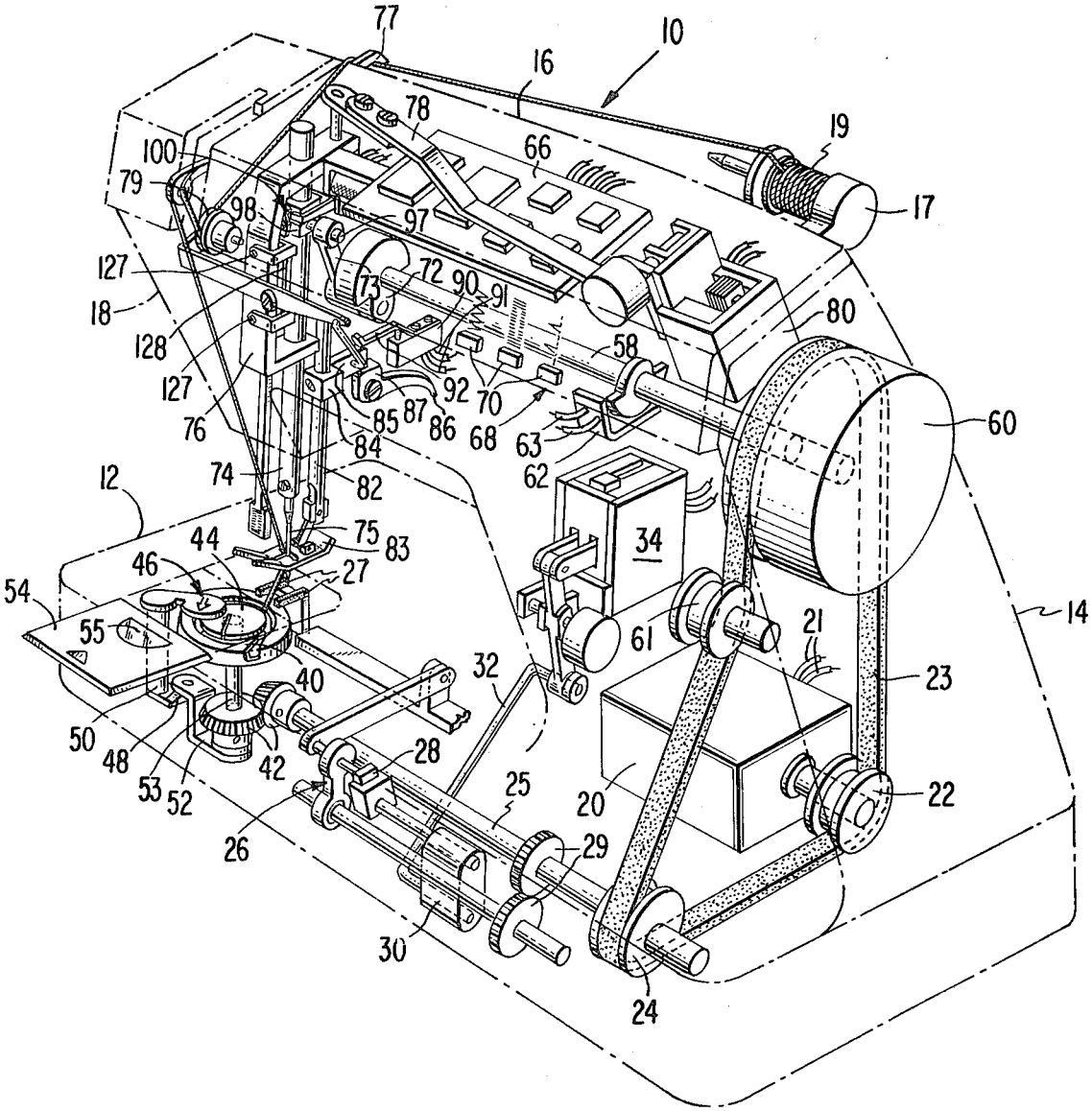
FIG. 1 is a perspective view of a sewing machine implementing the present invention in which the frame is shown in phantom to provide the inner details of the sewing machine.

Referring to FIG. 1, there is disclosed a sewing machine 10 having a frame shown in phantom and including a bed 12 from one end of which there rises a standard 14 to support a bracket arm 16 in overhanging relationship to the bed, the bracket arm terminating in head 18. Supported in the bed 12 is a motor 20 the electric leads 21 of which may be connected to a source of power in a manner well known in the sewing machine art, so as to selectively actuate the sewing machine 10. The motor 20 is connected by means of pulley 22 and timing belt 23 to a drive pulley 24 for a drive shaft 25 connected by gearing 29 to a sewing machine feed system 26 which terminates in feed dog 27. The feed system 26 may, typically, be provided with a slide block and slide arrangement 28 providing a means to vary the extent and direction of the feed by the feed dog 27. Selective rotation of the slide block and slide arrangement 28 to vary feed is provided through a lever 30 connected to the slide block and slide arrangement and having the other end thereof connected by link 32 to a feed linear motor 34 which may be directed by an electronic control to position the slide block and slide arrangement 28 in a selected discrete position. A typical feed system which might be implemented in the bed 12 of the sewing machine 10 is one similar to that disclosed in the U.S. Pat. No. 3,527,183, which issued on Sept. 8, 1970 to Szostak, and which is hereby incorporated by reference herein.

Also supported within the bed 12 is a looptaker 40 which is driven by way of bevel gear connection 42 to the drive shaft 25. Supported within the looptaker 40 is a bobbin 44. A wind lever 46 is provided which may be shifted in a counterclockwise direction to allow entry of the bobbin 44 into the looptaker 40, or may be shifted to a central position to retain the bobbin 44 therein. The wind lever 46 may also be shifted to an extreme clockwise position, as viewed in FIG. 1, in which a cam 48 situated on the end of a shaft 50 to which the wind lever 46 is attached, urges a bracket 52 upwardly to bring post 53, which is situated centrally of the looptaker 40, into engagement with the bobbin 44 to initiate rotation thereof for the purpose of winding upper thread on the bobbin to provide a source of lower thread for a lock stitch. Further particulars on a specific desirable arrangement for replenishing bobbin thread may be had by reference to the U.S. Pat. No. 3,693,566, issued on Sept. 26, 1972 to Ketterer, which patent is hereby incorporated by reference herein. A bed slide plate 54 is provided on bed 12, which slide plate may be slid away from the looptaker 40 and wind lever 46 in order to expose the same for initiation of the bobbin winding process or for any required maintenance of the mechanisms in that area. The bed slide plate 54 is provided with a window 55 by which the status of the lower thread supply on the bobbin 44 may be monitored.

Supported within the bracket arm 16 is a horizontal arm shaft 58 which is connected to the motor 20 by a handwheel pulley combination 60, and in which the belt 23 is engaged with the pulley portion thereof. An idler pulley 61 is provided so that an efficient motion transmitting arrangement may be maintained between the electric motor 20 and drive shaft 25 and horizontal arm shaft 58. The horizontal arm shaft 58 supports thereon a portion of a pulse generator 62 which is connected by leads 63 to an electronic control arrangement 66 also supported in the bracket arm 16. The pulse generator 62 provides a signal synchronized to the operations of the sewing machine 10, and provides a synchronization signal to the electronic control arrangement 66 so as to allow the electronic control arrangement to, for example, initiate operation of the feed linear motor 34 at the proper time in the sewing cycle to vary the extent and direction of the feeding motion implemented by the feed dog 27. The bracket arm 16 includes a control panel 68 supporting therein pattern selection buttons 70 which are also connected to the electronic control arrangement 66 in order to provide for the transfer of specific pattern information from the electronic control arrangement to the linear motors of the sewing machine. More specific information on a particular electronic control arrangement 66 may be had by reference to U.S. Pat. Nos. 3,847,100 and 3,872,808, issued on Nov. 12, 1974 and Mar. 25, 1975, respectively, and assigned to the assignee of this invention, which patents are hereby incorporated by reference herein.

Figure 3:
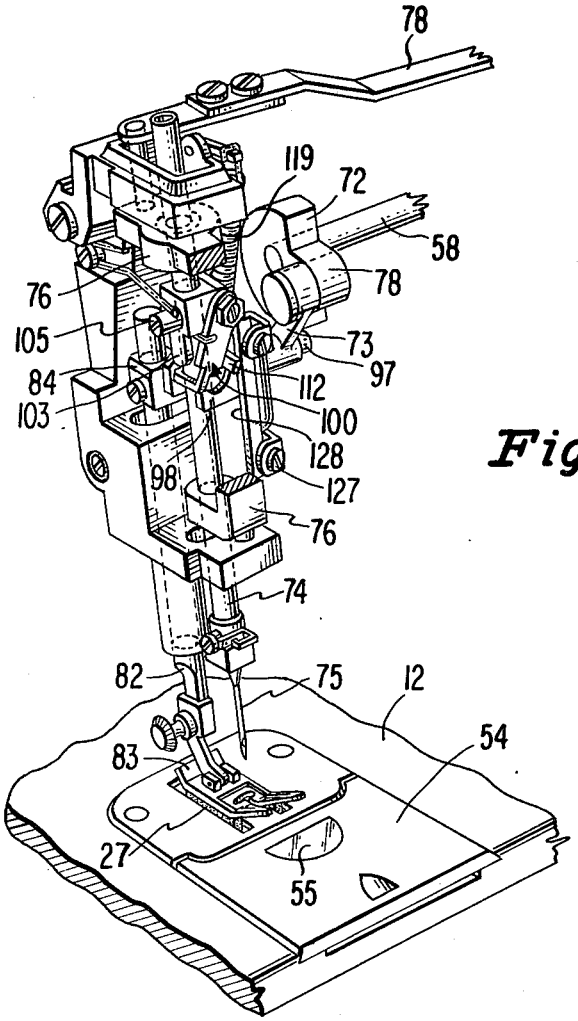
FIG. 3 represents a perspective view of a basting stitch initiated by needle bar overthrow illustrating the needle bar latch being driven into the disconnected position.
Figure 2:
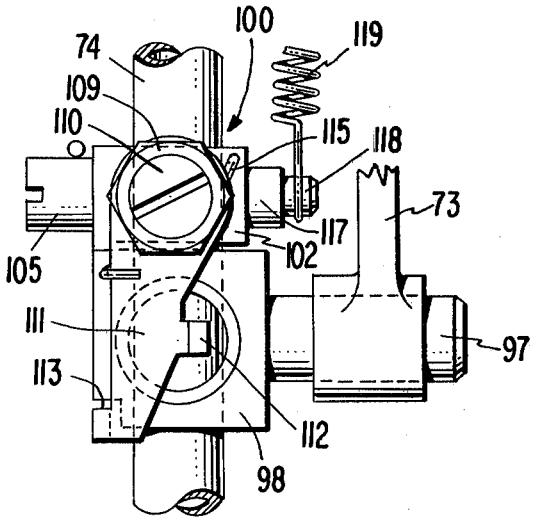
FIG. 2 is a detached front elevation of a latch mechanism attached to the needle bar of the sewing machine of FIG. 1.

In the head end 18, the arm shaft 58 terminates in a crank 72 which is connected by link 73 to a latch mechanism 100 on a needle bar 74 supported for endwise reciprocation in a needle bar gate 76 carried for oscillation in the head 18 (see also FIGS. 2 and 3). The needle bar 74 terminates in a sewing needle 75, which sewing needle cooperates with the looptaker 40 supported in the bed 12 of the sewing machine 10 in the formation of lock stitches. The needle bar gate 76 is urged into selective oscillation by the connections of a driving arm 78 thereto, which driving arm is operatively connected to a bight linear motor 80 operating under the control of the electronic control arrangement 66 to influence selective oscillations of the needle bar gate and selective lateral motion of the needle bar 74 and sewing needle 75 affixed thereto. Supported in the head 18 behind the needle bar 74, is a presser bar 82 which is visible in FIG. 1 having a presser foot 83 affixed to the lower end thereof as is usual in the sewing machine art. The presser bar 82 has affixed thereto a presser bar guide bracket 84, which guide bracket is fashioned with a rearwardly directed arm 85 designed for engagement with a cam surface 87 of a presser bar lift lever 86, so that the presser foot 83 affixed to the end of the presser bar 82 might be elevated out of contact with work material supported on the sewing machine bed 12. Behind the presser bar 82, the sewing machine frame supports a switch 90 having leads 91 connected to the electronic control arrangement 66. Switch 90 includes an actuating arm 92 which extends over the rear arm 85 of the presser bar guide bracket 84, so that elevation of the presser bar 82 by the presser bar lift lever 86 will actuate the switch 90, for example, to a closed position from an open position. Thus, information is provided to the electronic control arrangement 66 that the presser bar 82 has been elevated.

Supported on the back of the bracket arm 16 is a thread post 17, on which post is supported an upper thread spool 19. Thread from the thread spool 19 extends to pivot 77 on the back of head 18 and from there to the tension discs of a conventional tension 79 supported in the top front of the head. In the usual fashion in sewing machines, the thread thereafter passes to a conventional sewing machine take up (not shown) and then to the eye (not shown) of the sewing needle 75.

Referring now to FIG. 2, there is shown the connection between the link 73 of FIG. 1 and the needle bar 74, which is implemented by the latch mechanism 100 affixed to the needle bar 74 in its upper portion (see FIGS. 2 and 3). A rectangular collar 102 having a downwardly extending tang 103 which is received in the bifurcated portion 98 of a driving stud 97, contains a threaded hole which receives a screw 105 having an elongated head portion. The link 73 is shown connected in FIG. 1 to the driving stud 97. The screw 105 extends through the threaded hole in the rectangular collar 102 and firmly attaches the collar to the needle bar 74. Located on the front side of the rectangular collar 102 and supported on eccentric collar 109, held positioned to the rectangular collar by a screw 110, is a latch lever 111. The latch lever 111 has a forwardly extending ear 112 spaced from the eccentric collar 109 and a rearwardly extending lug having a latch surface 113 located a sufficient distance from the eccentric collar 109 to crimp the lower edge of the bifurcated portion 98 of the driving stud 97 when the bifurcated portion is in intimate contact with the lower surface of the rectangular collar 102. Adjustments for proper clearance between the latch surface 113 and bifurcated portion 98 are provided for by rotation of the eccentric collar 109 on which latch lever 111 is supported and tightening of the screw 110 to hold the eccentric collar 109 in the selected adjusted position.

Also supported by eccentric collar 109 and biased on the rectangular collar 102 is a torsion spring 115. The torsion spring 115 biases the latch lever 111 in counterclockwise direction, as viewed in FIG. 2, thereby to engage the rearwardly extending latch surface 113 onto the bifurcated portion 98 of the driving stud 97. Opposite the screw 105 of the rectangular collar 102 is a post 117 extending from the collar 102, which post 117 contains a peripherial groove 118 on its end. The peripheral groove 118 receives one end of a needle bar elevating spring 119, the other end of which is supported on the sewing machine frame. The spring 119 serves to elevate the needle bar 74 whenever the latch surface 113 is disengaged from the bifurcated portion 98 of the driving link 97.

The needle bar gate 76 has attached thereto by screws 127 to the front thereof a latch release abutment member 128 which extends around the gate to the inside thereof adjacent the forwardly extending ear 112 of the latch lever 111. As explained in the U.S. Pat. No. 3,782,311, issued on Jan. 1, 1974 to Adams et al, and assigned to the assignee of this invention, and incorporated herein by reference thereto, movement of the gate 76 on its support bearings will cause the latch release abutment member 128 to have a portion thereof strike the forwardly extending ear 112 of the latch lever 111 and separate the latch surface 113 of the rearwardly extending lug from the lower edge of the bifurcated portion 98 of the driving stud 97, thus permitting the needle bar elevating spring 119 to draw the needle bar 74 into an elevated position.

In order to have the needle bar gate 76 move to the position just described so as to disconnect the needle bar 74 from the driving stud 97, the driving arm 78 must move to the right as viewed in FIG. 3 and beyond the normal range of jogging motion for the sewing needle 75. A fuller explanation of the manner in which this is implemented may be had by reference to the U.S. Pat. No. 4,327,654, issued on May 4, 1982, to Odermann et al, and assigned to the assignee of the present application, and is hereby incorporated by reference herein.

Figure 4:
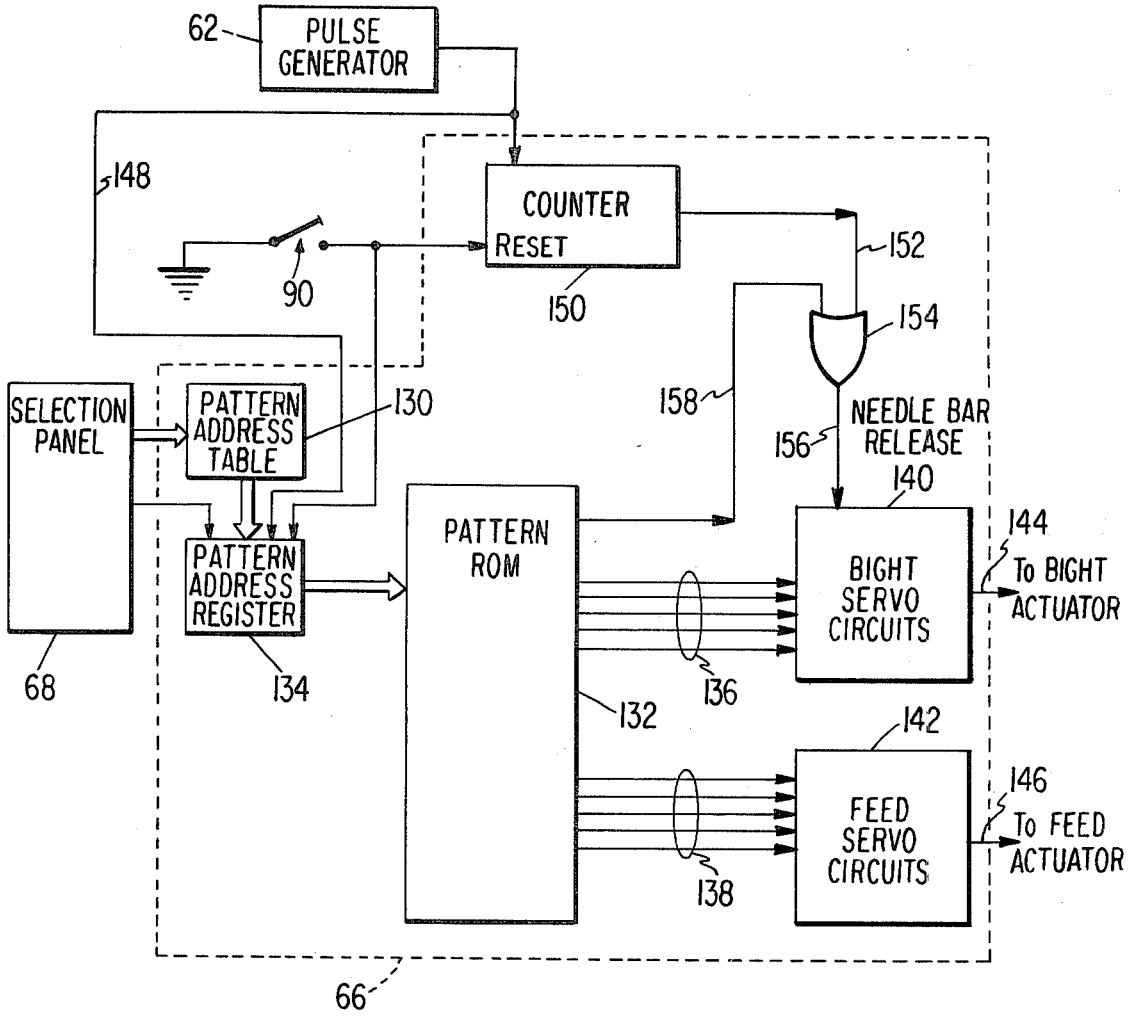
FIG. 4 is a block diagram of the circuit incorporated in the sewing machine of FIG. 1 to implement the invention.

Referring now to FIG. 4, there is shown a block diagram for the electronic control arrangement 66 and other components in the sewing machine 10 shown in FIG. 1 in order to enable the practice of the applicant's invention. The electronic control arrangement 66 is implemented by those elements within the dotted line 66. Thus, the selection panel 68 communicates with a pattern address table 130 of the electronic control arrangement to determine the initial pattern address for the pattern information stored in a pattern ROM (read only memory) 132. The pattern address table 130 presents the pattern address to a pattern address register 134 which presents its information to the pattern ROM 132 for transfer of bight and feed information therefrom along lines 136, 138 to bight servo circuits 140 and feed servo circuits 142, respectively. The information from the bight servo circuits 140 and the feed servo circuits 142 are transferred to the bight linear actuator 80 and feed linear actuator 34, respectively, along lines 144 and 146, respectively. With each stitch of the sewing machine 10, the pulse generator 62 passes a signal along line 148 to the pattern address register 134, to update the pattern address register so that the succeeding stitch information of the pattern would be released from the pattern ROM 132 to the bight and feed servo circuits 140, 142. The output from the pulse generator 62 is also applied to a counter 150, which counter is ineffective unless initiated by closing of the switch 90, which closing is implemented by elevation of the presser bar 82 by means of the presser bar lift lever 86. When the presser bar 82 is elevated by the presser bar lift lever 86, the switch 90 is closed and the counter 150 is reset to initiate count. When the motor 20 of the sewing machine 10 is activated, the arm shaft 58 revolves and pulse generator 62 generates pulses which are counted by the counter 150. After a count of, for example, three stitches is reached, a signal passes along the line 152 to OR 154. A signal on line 152 will cause an output on line 156 from the OR 154 to the bight servo circuits 140 to initiate an overthrow of the bight linear actuator 80 according to the teachings in the above referenced U.S. Pat. No. 4,327,654, so that the latch release abutment member 128 will strike the forwardly extending ear 112 of the latch lever 111 to cause separation of the latch surface 113 from the bifurcated portion 98 of the driving stud 97. Line 158 is provided extending from pattern ROM 132 to OR 154 so that needle bar release might be implemented at other times, for example, while basting or implementing a blindstitch.

Thus elevation of the presser bar lift lever 86 to close the switch 90 by deflecting the actuating arm 92 thereof by means of the rear arm 85 of the presser bar guide bracket 84, and operation of the motor 20 for a selected number of stitches, by way of example, three, will effect a disengagement of the latch lever 111 from the driving stud 97 so as to inhibit further endwise reciprocation of the needle bar 74. With the above described modification to the sewing machine 10, bobbin winding might be initiated by (1) raising the presser bar 82 to an elevated position by rotating the presser bar lift lever 86, (2) opening the bed slide plate 54 and rotating the wind lever 46 to its most counterclockwise position, and (3) directing the needle thread from the eye of the sewing needle to beneath the presser foot and around the presser foot retaining thumb screw. The sewing motor 20 may then be activated to initiate the endwise reciprocation of the needle bar 74 to insure that the upper thread is directed onto the bobbin 44 as taught in the above referenced U.S. Pat. No. 3,693,566. Thereafter, endwise reciprocation of the needle bar 74 is held in abeyance. Thus, implementation of the bobbin winding has been simplified.

I claim:

1. A sewing machine comprising: a frame; an endwise reciprocable needle bar supported by said frame; a sewing needle supported by said needle bar; means for selectively actuating said needle bar in endwise reciprocation; means for providing a signal on each endwise reciprocation of said needle bar; means for selectively disconnecting said actuating means from said needle bar to suspend endwise reciprocation of said needle bar while continuing actuation of said actuating means; a presser bar supported by said frame; means for selectively elevating said presser bar; a switch supported for actuation thereof by elevation of said presser bar; means responsive to actuation of said switch, and actuation of said actuating means for a selected number of said signals from said providing means, for initiating operation of said disconnecting means to suspend endwise reciprocation of said needle bar while continuing actuation of said actuating means.

2. A sewing machine as claimed in claim 1 wherein said initiating means further comprises: a counter responsive to actuation of said switch to initiate count of signals from said providing means; and an OR gate responsive to a signal from said counter after completion of a selected number of signals from said signal providing means to initiate operation of said disconnecting means.

3. A method for implementing bobbin winding in place in a looptaker of a sewing machine having a frame, an endwise reciprocable needle bar supported by said frame, a sewing needle supported by said needle bar, means for selectively actuating said needle bar in endwise reciprocation, means for selectively disconnecting said actuating means from said needle bar to suspend endwise reciprocation of said needle bar while continuing actuation of said actuating means, a presser bar supported by said frame, means for selectively elevating said presser bar, the method comprising the steps of:

elevating said presser bar;

actuating said selective actuating means;

counting the number of endwise reciprocations of said needle bar;

initiating operation of said disconnecting means to suspend endwise reciprocation of said needle bar while continuing actuation of said actuating means upon a count of a selected number of endwise reciprocations of said needle bar.

* * * * *